US006532604B2

(12) United States Patent
Moser

(10) Patent No.: US 6,532,604 B2
(45) Date of Patent: Mar. 18, 2003

(54) BEDPAN

(76) Inventor: Scott A. Moser, 800 Silverado St., Suite 324, La Jolla, CA (US) 92037

( * ) Notice: Subject to any disclaimer, the term of this patent is extended or adjusted under 35 U.S.C. 154(b) by 0 days.

(21) Appl. No.: 09/927,397

(22) Filed: Aug. 13, 2001

(65) Prior Publication Data

US 2003/0028959 A1 Feb. 13, 2003

(51) Int. Cl.[7] ..... A61G 9/00

(52) U.S. Cl. ..... 4/450; 4/452; 4/454; 604/349; D24/54

(58) Field of Search ..... 4/450, 452, 454, 4/114.1, 144.1–144.4; D24/54; 604/349

(56) References Cited

U.S. PATENT DOCUMENTS

| | | | | | |
|---|---|---|---|---|---|
| 381,972 | A | | 5/1888 | Tooker | |
| 412,734 | A | | 10/1889 | Drahos | |
| 579,512 | A | | 3/1897 | Borling | |
| 698,419 | A | * | 4/1902 | Taylor | 4/450 |
| 897,434 | A | | 9/1908 | Waltz | |
| 916,864 | A | | 3/1909 | Henhapl | |
| 967,638 | A | * | 8/1910 | Hogan | 4/450 |
| 1,188,553 | A | * | 6/1916 | Mudd | 4/450 |
| 1,289,650 | A | | 12/1918 | Cappellari | |
| 2,594,339 | A | * | 4/1952 | Nugent | 4/450 |
| 2,611,903 | A | | 9/1952 | Wakeman | 4/112 |
| 3,377,631 | A | * | 4/1968 | Whitney | 4/452 |
| 4,368,548 | A | | 1/1983 | Glass | 4/451 |
| 5,226,182 | A | | 7/1993 | Tucker | 4/452 |
| 5,778,458 | A | | 7/1998 | Speelman | 4/452 |

* cited by examiner

*Primary Examiner*—Gregory Huson
*Assistant Examiner*—Tuan Nguyen
(74) *Attorney, Agent, or Firm*—Welsh & Flaxman LLC

(57) ABSTRACT

A bedpan providing ease of use, comfort, and cleanability. The bedpan includes a body member defining a reservoir shaped and dimensioned for receiving bodily waste. The body member includes a closed base section adapted for retaining bodily wasted deposited within the bedpan and an open support section. The support section includes a central opening providing access to the reservoir defined by the body member. The central opening is defined by first and second inwardly inclined walls extending from a first end of the body member toward a second end of the body member. The support section further includes a forward support surface adjacent the first end of the body member. The forward support surface has a forward end adjacent the base member and a rearward end adjacent the first and second inwardly inclined walls, wherein the forward support surface is generally horizontal and tapers downwardly as it extends toward the base section. The forward support surface and first and second inwardly inclined walls being so positioned to lift the pelvic region as the first end of the body member is slid under a patient and separate the buttocks to facilitate bowel movement.

15 Claims, 6 Drawing Sheets

BEDPAN

BACKGROUND OF THE INVENTION

1. Field of the Invention

The invention relates to bedpans. More particularly, the invention relates to a bedpan which is easier to use, more comfortable and better adapted to function as intended.

2. Description of the Prior Art

Bedpans have been in use in various forms for many years. Bedpans generally provide those individuals confined to a bed an acceptable way in which to dispose of bodily waste. However, while technology and ingenuity have been applied in many areas of medicine, bedpans currently used today are substantially similar in design to those used for the past 100 years.

With that in mind, standard professional bedpans have many problems. They are difficult to place under a patient, they are uncomfortable to use and they are difficult to clean. Prior bedpans commonly require that the patient be rolled on his or her side while the bedpan is placed under the patient so that he or she may be rolled back onto the bedpan.

The process of rolling a patient on his or her side in order to properly position a bedpan presents a substantial problem for those patients who are not in condition to be subjected to the rigors of being rolled around a bed. Even where the patient is well enough to be rolled on his or her side, the caregiver must exert great physical force to rollover of patient who might not have the physical ability to assist the caregiver in positioning the bedpan.

Once the bedpan is properly positioned under the patient, current bedpan designs are not well suited for positioning adjacent the rectum of the patient and are consequently often uncomfortable. For example, the fact that prior bedpans lift the patient's midsection, makes it difficult for those with sensitive backs or hip problems to use these bedpans. In fact, it is often impossible for those recovering from back or hip surgery to use any currently available bedpans.

In addition to lifting the midsection of an individual in an undesirable manner, current bedpans push the buttocks together, causing the patient to lose the sensation required for moving his or her bowels. If the patient is, however, finally able to relax enough to move his or her bowels, the hospital staff is left with a much greater mess than if a toilet were used by the patient. With this in mind, standard industry bedpans are difficult to clean, because solid waste must be wiped, or hosed, out into a toilet where spillage is likely.

A bedpan taking advantage of current technology and anatomical knowledge is, therefore, needed. The present invention provides such a bedpan. The inventors of the present bedpan have created various mold of the human pelvic region and applied digitally designed computer models in developing a bedpan which will truly address the needs of bedridden patients. In addition to considering the bone structure associated with the pelvic region, the inventors of the present bedpan considered tissue movement associated with the use of bedpans. The technologically advanced techniques applied in the development of the present bedpan have resulted in a bedpan offering improved comfort, use and functionality.

SUMMARY OF THE INVENTION

It is, therefore, an object of the present invention to provide a bedpan providing ease of use, comfort, and cleanability. The bedpan includes a body member defining a reservoir shaped and dimensioned for receiving bodily waste. The body member includes a closed base section adapted for retaining bodily wasted deposited within the bedpan and an open support section. The support section includes a central opening providing access to the reservoir defined by the body member. The central opening is defined by first and second inwardly inclined walls extending from a first end of the body member toward a second end of the body member. The support section further includes a forward support surface adjacent the first end of the body member. The forward support surface has a forward end adjacent the base member and a rearward end adjacent the first and second inwardly inclined walls, wherein the forward support surface is generally horizontal and tapers downwardly as it extends toward the base section. The forward support surface and first and second inwardly inclined walls being so positioned to lift the pelvic region as the first end of the body member is slid under a patient and separate the buttocks to facilitate bowel movement.

It is also an object of the present invention to provide a bedpan wherein the first inwardly inclined wall has an outer surface which is of a generally concave shape and the second inwardly inclined wall has an outer surface which is of a generally concave shape.

It is another object of the present invention to provide a bedpan wherein the first inwardly inclined wall is a mirror image of the second inwardly inclined wall.

It is a further object of the present invention to provide a bedpan wherein the first inclined wall has a first end adjacent the forward support surface and a second end adjacent the second end of the body member. The first end of the first inclined wall is coterminous with the forward support surface. Similarly, the second inclined wall has a first end adjacent the forward support surface and a second end adjacent the second end of the body member, wherein the first end of the first inclined wall is coterminous with the forward support surface.

It is also another object of the present invention to provide a bedpan wherein the first and second inclined walls increase in height as they extend from the first end of the body member to the second end of the body member.

It is yet another object of the present invention to provide a bedpan wherein the first inclined wall has a first end adjacent the forward support surface and a second end adjacent the second end of the body member, the second end of the first inclined wall being joined with the second end of the second inclined wall adjacent the second end of the body member.

It is still another object of the present invention to provide a bedpan wherein the forward support surface inclines upwardly as it extends from the first end of the body member toward the second end of the body member.

It is a further object of the present invention to provide a bedpan wherein the body member includes first and second lateral support surfaces respectively adjacent the first and second inwardly inclined walls.

It is still a further object of the present invention to provide a bedpan wherein the first and second lateral support surfaces are coterminous with the forward support surface adjacent the first end of the body member.

It is also an object of the present invention to provide a bedpan wherein the first inclined wall has a first end adjacent the forward support surface and a second end adjacent the second end of the body member and the second inclined wall has a first end adjacent the forward support surface and a second end adjacent the second end of the body member. A concave opening is defined by the first end of the first inclined wall and the second inclined wall, the concave opening being shaped and dimensioned for positioning of patient's rectum adjacent thereto.

It is still another object of the present invention to provide a bedpan wherein the forward support surface includes a central ridge.

It is yet another object of the present invention to provide a bedpan wherein the central ridge extends between first end of the body member and the central opening.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
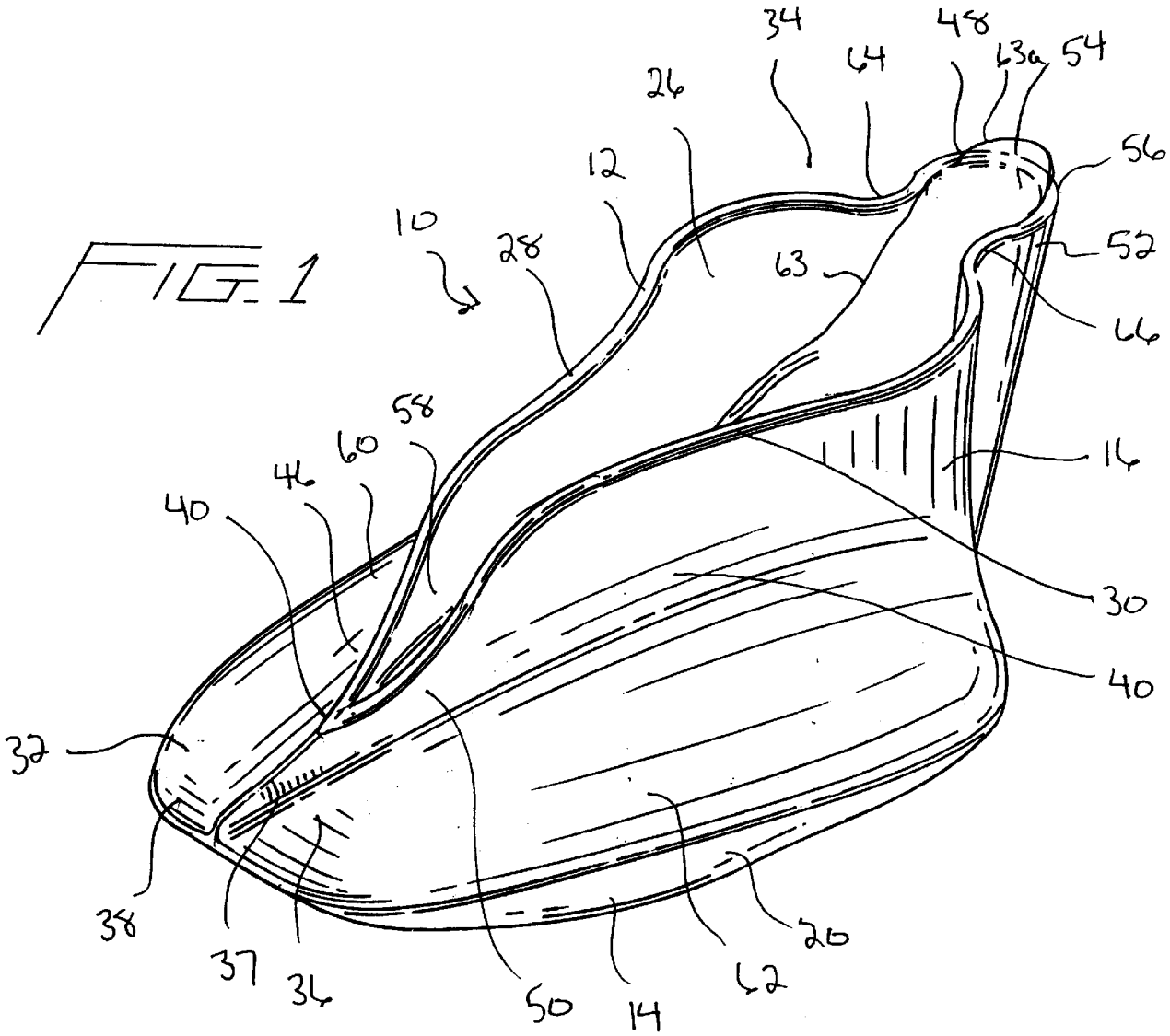
FIG. 1 is a perspective view of the present bedpan.
Figure 2:
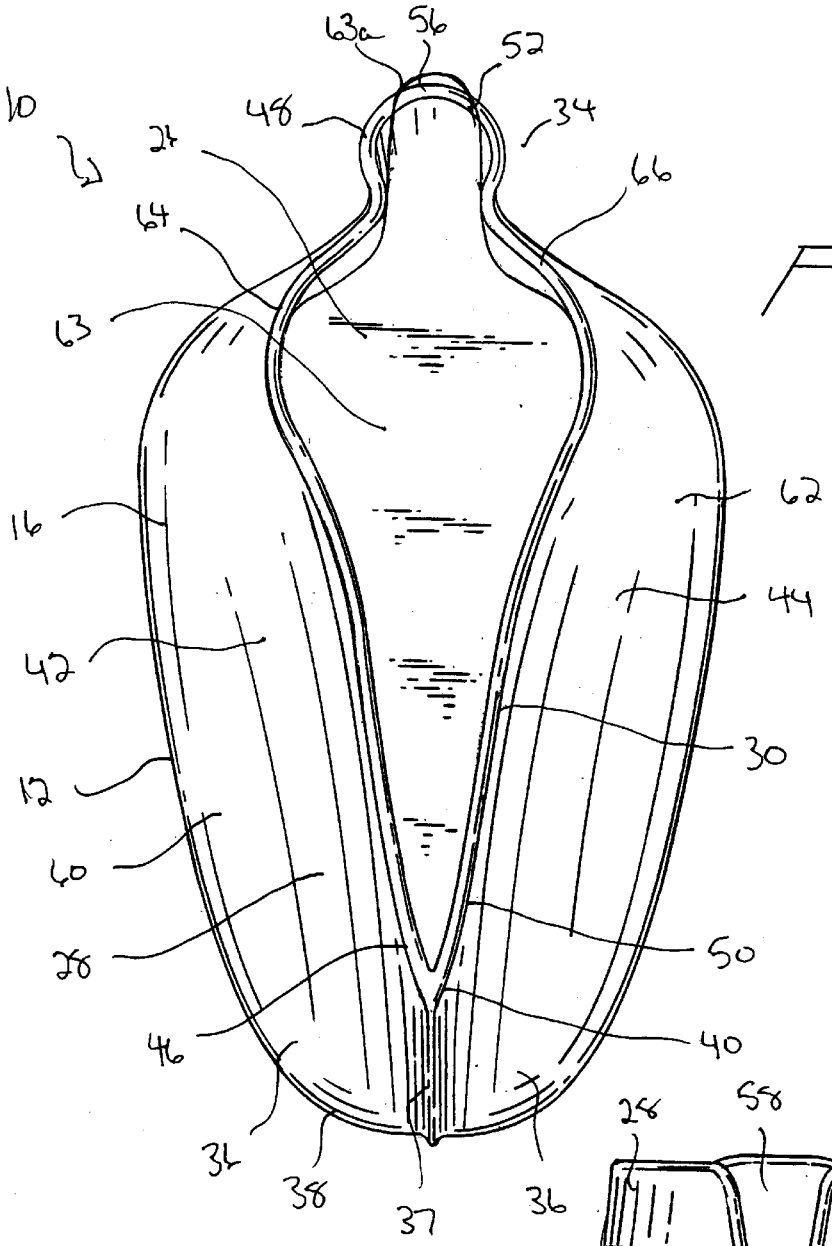
FIG. 2 is a top view of the bedpan shown in FIG. 1.
Figure 3:
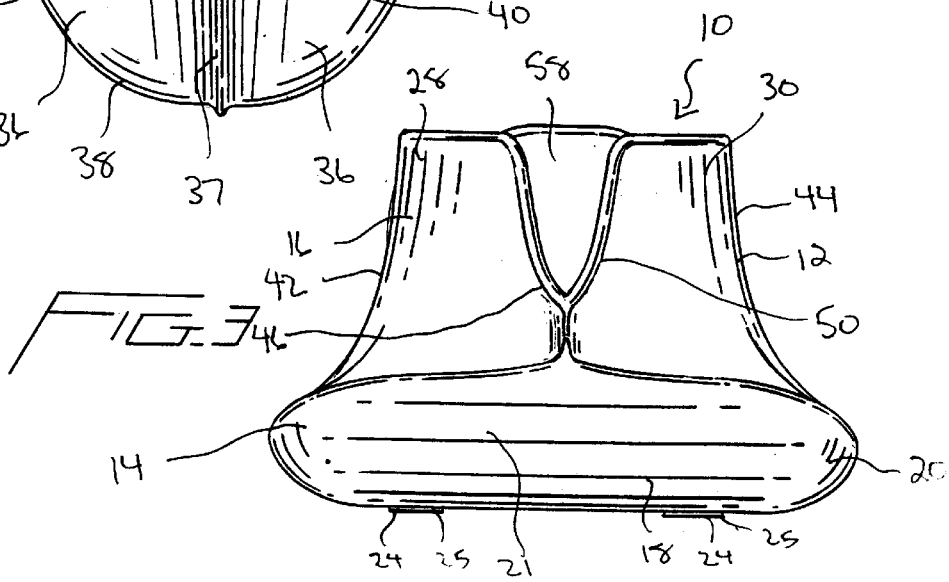
FIG. 3 is a front view of the bedpan shown in FIG. 1.
Figure 4:
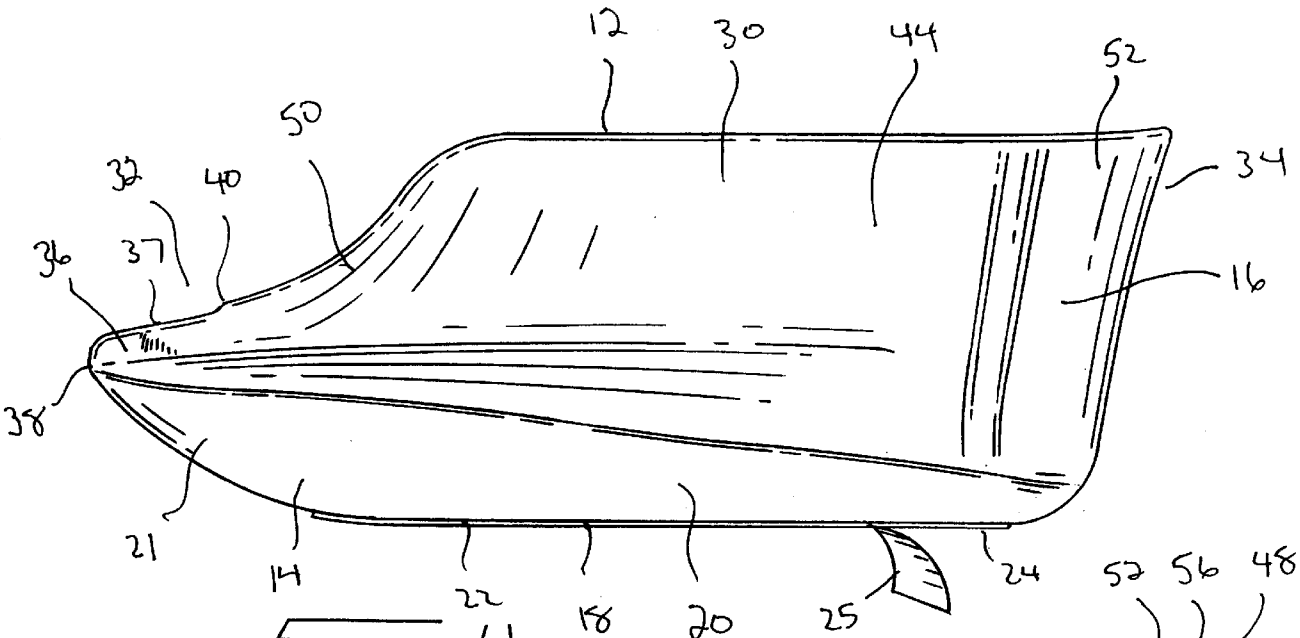
FIG. 4 is a side view of the bedpan shown in FIG. 1.
Figure 5:
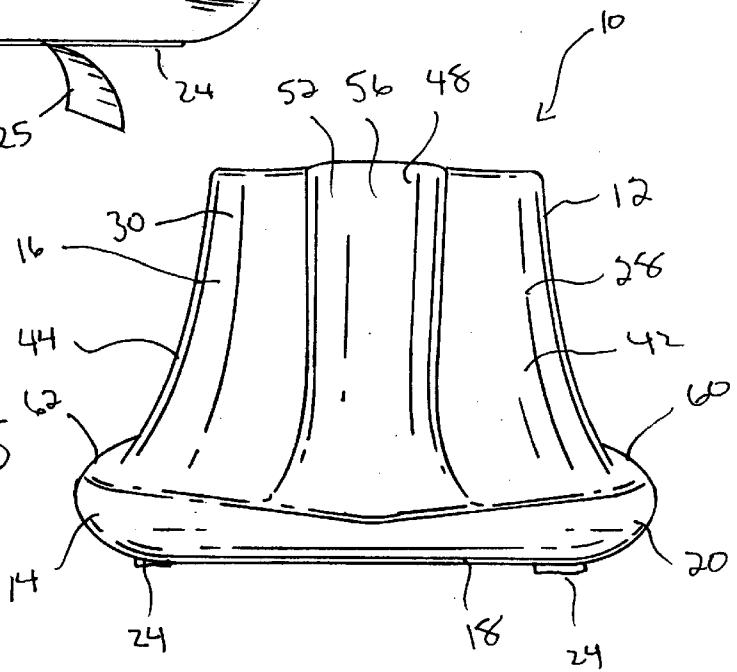
FIG. 5 is a rear view of the bedpan shown in FIG. 1.

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 to 5, a bedpan 10 in accordance with the present invention is disclosed. The bedpan 10 is designed to provide for ease of use, comfort, and cleanability. In fact, available technology has been applied in developing the present bedpan 10 so as to offer patients previously unrealized comfort and convenience.

The bedpan 10 generally includes a body member 12 defining a reservoir shaped and dimensioned for receiving bodily waste. The body member 12 includes a closed base section 14 adapted for retaining bodily wasted deposited within the bedpan 10 and an open support section 16.

In accordance with a preferred embodiment, the closed base section 14 is shaped and dimensioned for the receipt and temporary storage of bodily waste. The base section 14 is, therefore, provided with a substantially flat bottom wall 18 having upstanding walls 20 extending therefrom. The forward end 21 of the base section 14 extends upwardly as it meets the support section 16. The bottom wall 18 and upstanding walls 20 form a basin in which bodily waste is collected prior to disposal. In addition, the substantially flat surface provided by the bottom wall 18 permits those using the present bedpan 10 to lie the bedpan 10 on a countertop or worksurface without worrying that the bedpan 10 will spill over.

As will be better appreciated based upon the subsequent discussion regarding use of the present bedpan 10, the exterior surface 22 of the bottom wall 18 is provided with adhesive tape 24 covered with a release sheet 25 to facilitate secure positioning when the bedpan 10 is placed beneath a patient. Specifically, once exposed, the adhesive tape 24 grips a support surface when the bedpan 10 placed under the patient, but provides relatively free movement when the bedpan 10 is moved under the patient with the release sheet 25 covering the adhesive tape 24. While a specific gripping surface is disclosed above in accordance with a preferred embodiment of the present invention, various other gripping designs may be applied without departing from the spirit of the present invention.

As mentioned above, an open support section 16 is positioned above the based section 14. The open upper support section 16 is shaped and dimensioned to lift a patient upon the bedpan 10 and position his or her rectum for collection of bodily waste within the present bedpan 10. The support section 16 includes a central opening 26 providing access to the reservoir defined by the body member 12. The central opening 26 is defined by first and second inwardly inclined walls 28, 30 extending from a first end 32 of the body member 12 toward a second end 34 of the body member 12. The support section 16 further includes a forward support surface 36 adjacent the first end 32 of the body member 12. The forward support surface 36 has a forward end 38 adjacent the inclined forward end 21 of the base section 14 and a rearward end 40 adjacent the first and second inwardly inclined walls 28, 30. The forward support surface 36 is generally horizontal and inclines upwardly as it extends from its forward end 38 adjacent the base section 14 toward its rearward end 40 adjacent the first and second inwardly inclined walls 28, 30. The forward support surface 36 and first and second inwardly inclined walls 28, 30 are so positioned to lift the pelvic region as the first end 32 of the body member 12 is slid under a patient and separate the buttocks to facilitate bowel movement.

More specifically, and with reference to FIGS. 1 to 5, separation of the buttocks is facilitated by the central ridge 37 formed along the surface of the forward support surface 36. The ridge 37 longitudinally extends along the center of the forward support surface 36 from the forward end 38 of the forward support surface 36 adjacent the base section 14 to the point at which the forward support surface 36 and the central ridge 37 meet the central opening 26. In practice, and as will be discussed below in greater detail, the central ridge 37 functions to contact the buttocks as the bedpan 10 is slid under the patient and separates the flesh surrounding the perineum to reveal the individual's anus directly over the opening of the bedpan 10.

The first inwardly inclined wall 28 and the second inwardly inclined wall 30 are mirror images of each other. Each of the first and second inwardly inclined walls 28, 30 includes an outer surface 42, 44 shaped and dimensioned for receiving the buttocks of a patient. The outer surface 42, 44 of each inclined wall 28, 30 is generally concave. The concave shape conforms to the patient's body and enhances user comfort as the bedpan 10 is slid beneath the patient.

The first inwardly inclined wall 28 includes a first end 46 adjacent the forward support surface 36 and a second end 48 adjacent the second end 34 of the body member 12. Similarly, the second inwardly inclined wall 30 has a first end 50 adjacent the forward support surface 36 and a second end 52 adjacent the second end 34 of the body member 12. The first and second inwardly inclined walls 28, 30 each increase in height as they extend from the first end 32 of the body member 12 toward the second end 34 of the body member 12. In fact, the first end 46 of the first inwardly inclined wall 28 flows into the forward support surface 36 such that the first end 46 of the first inclined wall 28 is coterminous with the forward support surface 36. The first end 50 of the second inwardly inclined wall 30 similarly flows into the forward support surface 36 such that the first end 50 of the second inwardly inclined wall 30 is coterminous with the forward support surface 36.

The second ends 48, 52 of the first and second inwardly inclined walls 28, 30 meet at the second end 34 of the body member 12 to form a wall 54 blocking urine being expelled by a patient. That is, the second ends 48, 52 of the first and second inwardly inclined walls 28, 30 are joined to form an upwardly extending wall 54 at the second end 34 of the body member 12. In fact, the first and second inwardly inclined walls 28, 30 curve inwardly, outwardly and inwardly before they meet at the second end 34 of the body member 12. In this way, they create a handle/trough 56 for capturing urine. The meeting point of the first and second inwardly inclined walls 28, 30 is shaped to function as a wall, handle and pouring spout (as will be discussed below in greater detail).

With reference to the forward support surface 36, it inclines upwardly as it extends from the first end 32 of the body member 12 toward the second end 34 of the body member 12. In fact, the meeting point of the forward support surface 36 and the base section 14, substantially resembles a duck-bill. In accordance with a preferred embodiment of the present invention, the forward support member 36 is inclined at an angle from approximately 5° to approximately 2020 , although other angular orientations may be employed without departing from the spirit of the present invention.

As mentioned above, the first inwardly inclined wall 28 has a first end 46 adjacent the forward support surface 36 and the second inwardly inclined wall 30 has first end 50 adjacent the forward support surface 36 such that a concave opening 58 is defined by the first ends 46, 50 of the first inwardly inclined wall 28 and the second inwardly inclined wall 30. The concave opening 58 is shaped and dimensioned for positioning of patient's rectum adjacent thereto.

The body member 12 also includes first and second lateral support surfaces 60, 62 respectively adjacent the first and second inwardly inclined walls 28, 30. The first and second lateral support surfaces 60, 62 are coterminous with the forward support surface 36 adjacent the first end 32 of the body member 12 and provide additional user support when the present bedpan 10 is placed beneath a patient.

Figure 6:
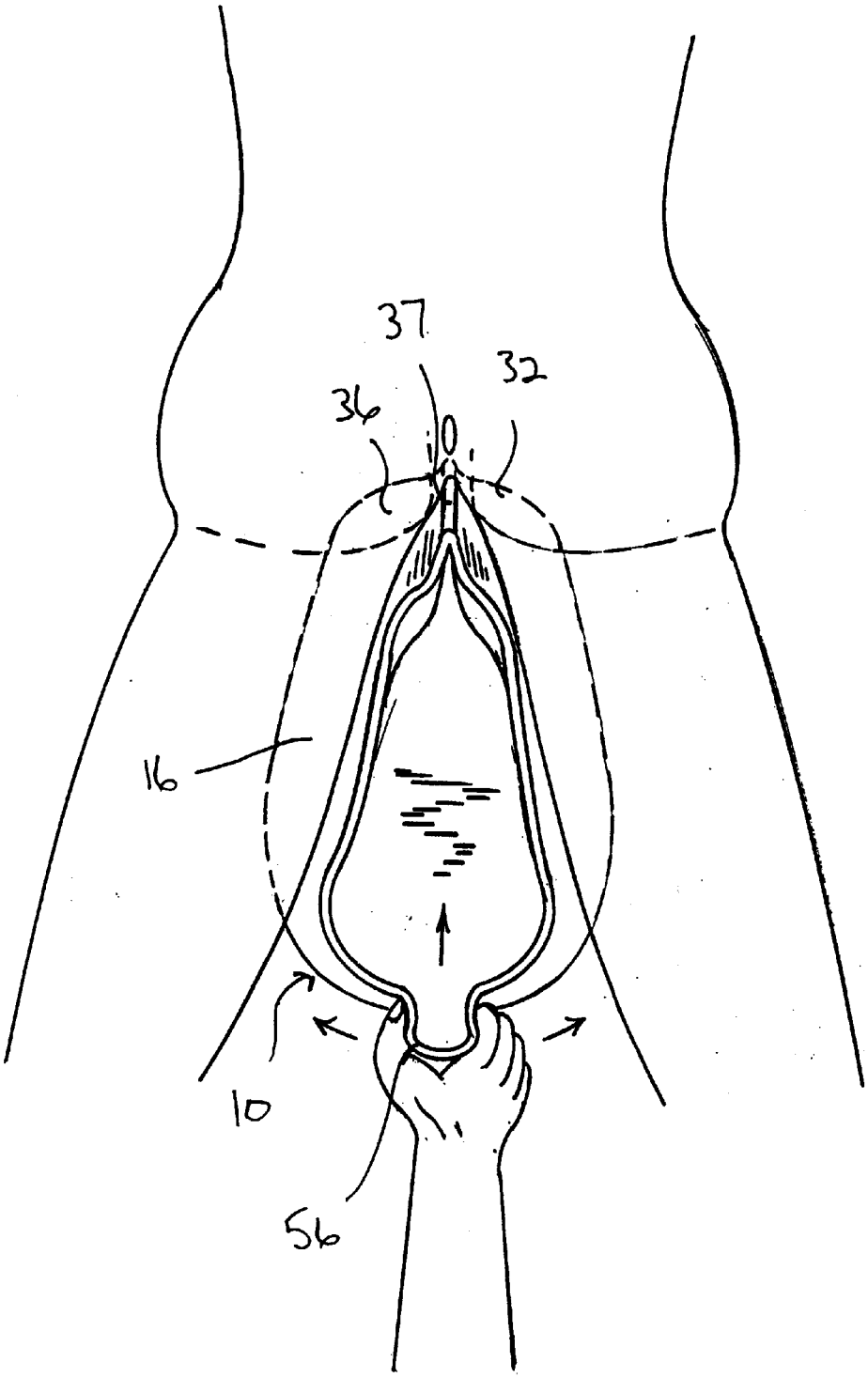
FIGS. 6, 7 and 8 are various views showing insertion of the present bedpan.
Figure 7:
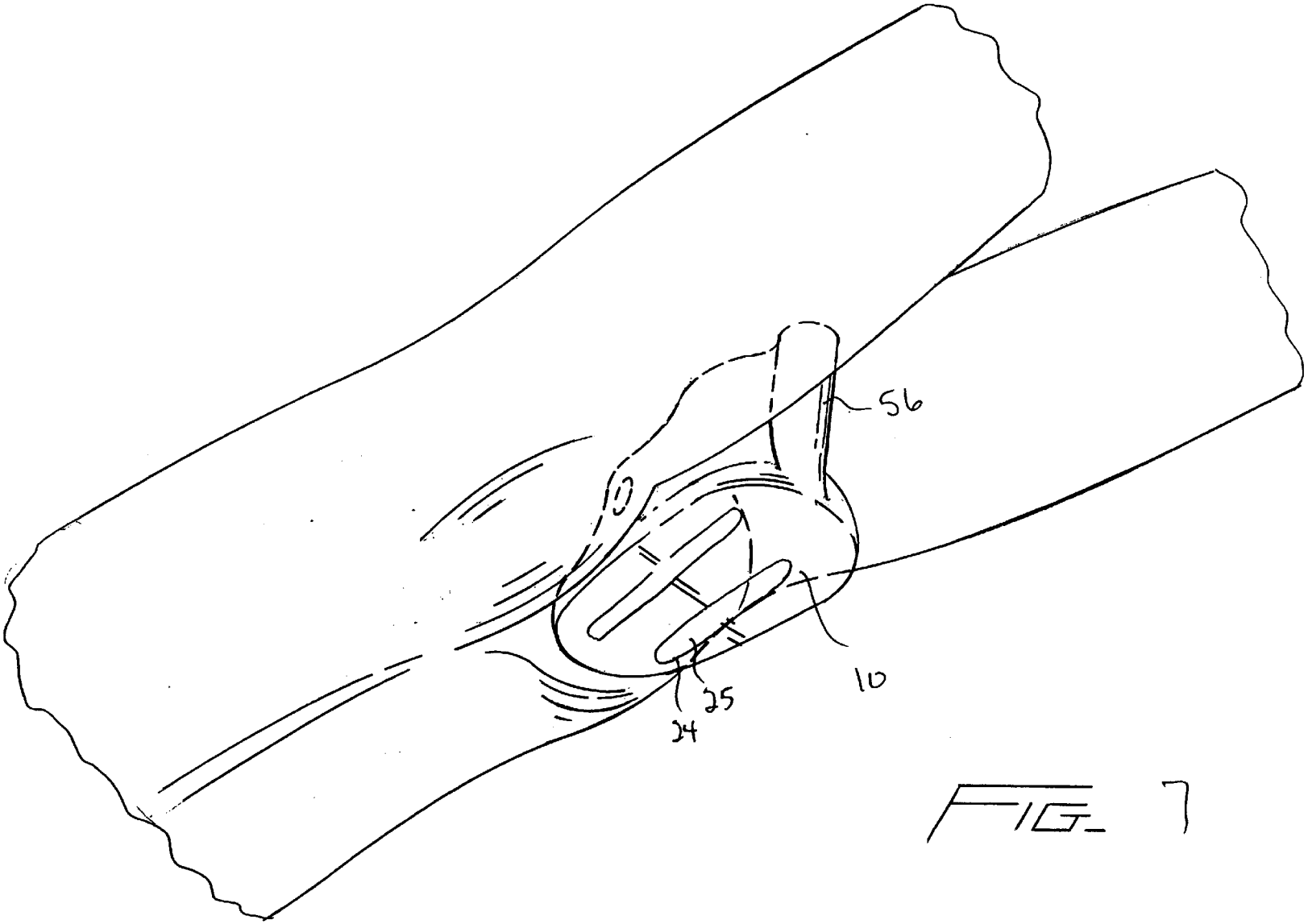
Figure 8:
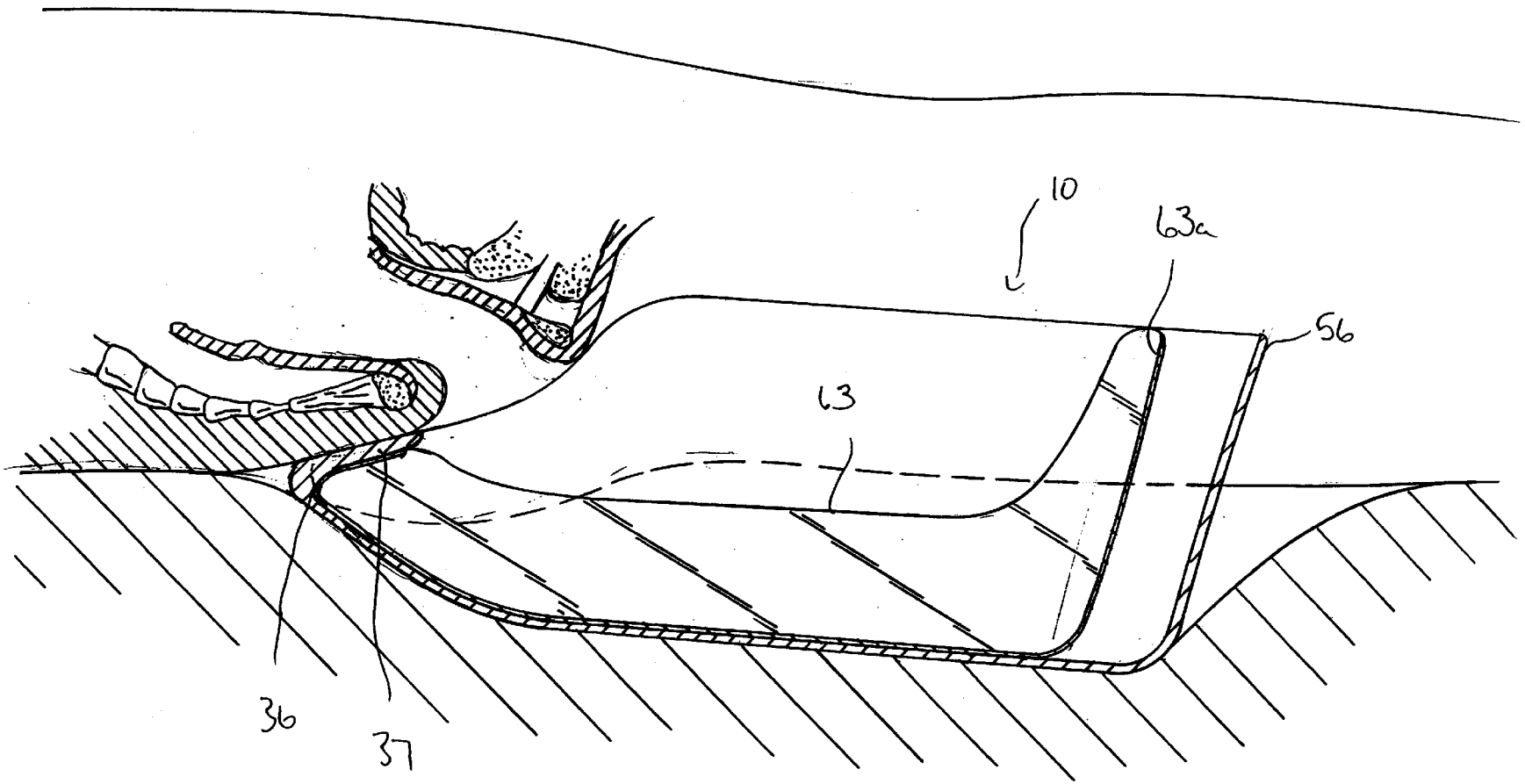

With reference to FIGS. 6, 7 and 8, the present bedpan is utilized in the following manner. While the present description relates to use of the present bedpan while the patient is in a flat position, the bedpan may be raised to any angle so that a patient in a seated position may use the present bedpan.

The patient's legs are first positioned such that the knees are approximately one foot apart. There is no need to bend the patient's legs. A paper insert 63 may then be positioned within the bedpan 10. The paper insert 63 is formed to fit the base section 14 of the bedpan 10 and may be readily positioned therein by the user. The paper insert 63 is provided with a tab 63*a*, allowing a caretaker to easily grab hold of it after patient use. The nurse then stands to either side of the bed and rests the bedpan 10 between the patient's knees with the duck-bill shaped forward support surface 36 pointed toward the point where the bed sheet comes into contact with the patient's skin.

The bedpan 10 is then slid forward at an angle that will separate the person from the mattress. The leading edge, or first end 32, of the bedpan 10 has an inverted T-shape which will match the shape formed by the meeting of the mattress, the patient's buttocks and the perianal region. This shape attempts to mimic the inverted T-shape formed between a bed and an individual's buttocks when the individual is lying on a bed. By creating the present bedpan 10 with a leading edge 32 having an inverted T-shape, the bedpan 10 is able to enter the space between the bed and buttocks while lifting the buttocks and depressing the mattress. Simultaneously, the central ridge 37, working in conjunction with general shape of the bedpan 10, gradually spreads the flesh of the buttocks. Continued forward movement of the bedpan 10 into position allows the central ridge 37 to separate the flesh surrounding the perineum to reveal the individual's anus directly over the opening of the bedpan 10.

The back end, or second end 34, of the bedpan 10 is equipped with a trough/handle 56 shaped to accommodate the left or right hand. The bedpan 10 is gripped firmly by this handle 56 and worked between the patient and the mattress with a side to side, zigzag motion.

While the bedpan 10 is positioned in this manner, the patient need not raise his or her pelvis. The first end 32 of the bedpan 10 may be pushed down into the bed to more easily slide the bedpan 10 under the patient and lessen the chances of catching on the softer skin of older patients (although the leading edge is rounded to avoid pinching of flesh).

As the bedpan 10 is slid under the patient, the nurse will notice the folds of the skin around the anus being pushed proximally. As mention above, this movement of the flesh around the perineum is achieved by providing an inverted T-shaped leading edge 32 and central ridge 37 which function to separate the buttocks and the flesh around the perineum to expose the individual's anus. When the nurse is able to clearly view the patient's anus and the first end 32 of the bedpan 10 is pressed against the front of the pelvis, the bedpan 10 has been introduced far enough under the patient. The patient's legs will then be draped across the support section 16 of the bedpan 10.

With regard to male patients, they will find that their testicles have been pushed up and out of the way by the bedpan 10. Female patients will find that the walls 28,30 of the bedpan 10 press into their flesh on either side of the mound pubis.

Additional confirmation that the bedpan 10 is in place will come from the patient who will feel that the first end 32 of the bedpan 10 has moved past their tailbone and that their buttocks are comfortably spread as they would be if they were sitting on a toilet.

Once properly positioned, the bedpan 10 may be left in place for long periods of time without discomfort to the patient. The bedpan 10 will remain locked in position by the friction between the bed and the patient's legs. The patient is then free to engage in a bowel movement and/or urination at his or her convenience. Male patients will be required to either direct their penis into the bedpan 10, or use an optional snap in tube (not shown) designed for this purpose. The tube will be slid into the pan in the handle area and remains locked in place. The flexible tube is then directed towards the patient and the penis is slipped inside. Urine is then directed by the tube into the bedpan 10.

After the bedpan 10 has been used, the bedpan 10 is slid out from under the patient by pulling on the handle 56 backwards away from the patient in a zigzag motion. The hand indentations 64, 66 on either side of the bedpan 10 may also be used. The flat bottom wall 18 of the bedpan 10 permits it to be securely placed on a mattress or table without worry that the contents will be spilled out. The bedpan 10 is then carried to the toilet by using the handle/ trough 56, the side indentations 64, 66 or resting the flat bottom wall 18 on the nurse's palm. As the paper 63 with the stool on it is pulled out into the toilet, the bedpan 10 is tipped so that the fluid is poured out of the handle/trough 56, which is shaped to act as a pour spout. The paper 63 can also be used to dump the stool sample onto a weight scale if desired.

In summary, the present bedpan has been designed with three major features. First, the bedpan is designed to be slipped under a patient with minimal effort. Second, the bedpan is comfortable enough to leave in place for long periods and is not injurious to patient's with sensitive back problems. Third, the present bedpan provides easier cleanup than traditional existing bedpans.

The bedpan is designed to be easily slipped under a patient. The front end of the pan is shaped somewhat like the combination of a duckbill and a saddle. The bedpan is introduced between and under the patient's legs with the legs slightly apart. The patient may be laying flat and also be elevated as high as 30 or 40 degrees. The caregiver then grasps the handle and slides the pan under the patient while working the pan from side to side. Adhesive tape on the bottom of the pan helps to secure the pan under the patient. As the bedpan is slipped under the patient, the duckbill/saddle portion of the pan slides between the bed and the patient's buttocks, causing a double wedge action which depresses the mattress and lifts the patient's buttocks tissue without having to lift the patient. Additionally, a vertically oriented wedge (i.e., ridge) separates the lobes of the buttocks to expose the anus. In accordance with a preferred embodiment of the present invention, the outside surface of the bedpan may be textured such that it will slide easily over damp skin.

With regard to user comfort, the pan is designed to fit snugly against the pelvic curve from the front as it passes the tailbone. In fact, the pan is substantially similar to sitting upon a saddle. Patients may feel as though nothing is under them, although they will feel that their buttocks are properly spread in preparation for a bowel movement in a manner similar to sitting upon a standard toilet. User comfort is further enhanced by the fact that the patient's pelvis is not lifted or rotated in the process of inserting the pan. This allows the pan to be left in place for hours if necessary. The patient will feel secure that the bedpan cannot shift under them since it is locked between their upper thighs and the mattress.

The cleaning process is improved by the use of disposable paper inserts which fit into the bedpan. Solid waste is captured by the paper, which may be pulled out and into the toilet. As the paper is pulled out, the liquid waste is poured out of the handle area. The paper is designed to disperse in water and can be flushed down the toilet along with the waste material. A quick rinsing will clean the bedpan for its next use.

While the preferred embodiments have been shown and described, it will be understood that there is no intent to limit the invention by such disclosure, but rather, the invention is intended to cover all modifications and alternate constructions falling within the spirit and scope of the invention as defined in the appended claims.

What is claimed is:

1. A bedpan providing ease of use, comfort, and cleanability, comprising:

a body member defining a reservoir shaped and dimensioned for receiving bodily waste, the body member including a closed base section adapted for retaining bodily wasted deposited within the bedpan and an open support section;

the support section including a central opening providing access to the reservoir defined by the body member, the central opening being defined by first and second inwardly inclined walls extending from a first end of the body member toward a second end of the body member, the support section further including a forward support surface adjacent the first end of the body member, the forward support surface having a forward end adjacent the base member and a rearward end adjacent the first and second inwardly inclined walls, wherein the forward support surface is generally horizontal and tapers downwardly as the forward support surface extends toward the base section;

the forward support surface and first and second inwardly inclined walls being so positioned to lift the pelvic region as the first end of the body member is slid under a patient and separate the buttocks to facilitate bowel movement; and wherein the first inclined wall has a first end adjacent the forward support surface and a second end adjacent the second end of the body member and the second inclined wall has a first end adjacent the forward support surface and a second end adjacent the second end of the body member, a concave opening being defined by the first end of the first inclined wall and the second inclined wall, the concave opening being shaped and dimensioned for positioning of patient's rectum adjacent thereto.

2. The bedpan according to claim 1, wherein the first inwardly inclined wall has an outer surface which is of a generally concave shape, and the second inwardly inclined wall has an outer surface which is of a generally concave shape.

3. The bedpan according to claim 1, wherein the first inwardly inclined wall is a mirror image of the second inwardly inclined wall.

4. The bedpan according to claim 1, wherein the first end of the first inclined wall is coterminous with the forward support surface, and the first end of the first inclined wall is coterminous with the forward support surface.

5. The bedpan according to claim 4, wherein the first and second inclined walls increasing in height as the first and second walls extend from the first end of the body member to the second end of the body member.

6. The bedpan according to claim 5, wherein the second end of the first inclined wall being joined with the second end of the second inclined wall adjacent the second end of the body member.

7. The bedpan according to claim 4, wherein the second end of the first inclined wall being joined with the second end of the second inclined wall adjacent the second end of the body member.

8. The bedpan according to claim 1, wherein the first and second inclined walls increasing in height as they extend from the first end of the body member to the second end of the body member.

9. The bedpan according to claim 1, wherein the second end of the first inclined wall is joined with the second end of the second inclined wall adjacent the second end of the body member.

10. The bedpan according to claim 1, wherein the forward support surface inclines upwardly as it extends from the first end of the body member toward the second end of the body member.

11. The bedpan according to claim 10, wherein the forward support member is inclined at an angle from approximately 5° to approximately 20°.

12. The bedpan according to claim 1, wherein the body member includes first and second lateral support surfaces respectively adjacent the first and second inwardly inclined walls.

13. The bedpan according to claim 12, wherein the first and second lateral support surfaces are coterminous with the forward support surface adjacent the first end of the body member.

14. The bedpan according to claim 1, wherein the forward support surface includes a central ridge.

15. The bedpan according to claim 14, wherein the central ridge extends between first end of the body member and the central opening.

* * * * *